US006578756B2

(12) United States Patent
Marumi

(10) Patent No.: US 6,578,756 B2
(45) Date of Patent: Jun. 17, 2003

(54) FILING DEVICE

(76) Inventor: Ren Marumi, Cypress suite 206, 2-7-5 Suwa, Ichihara-shi, Chiba (JP)

( * ) Notice: Subject to any disclaimer, the term of this patent is extended or adjusted under 35 U.S.C. 154(b) by 0 days.

(21) Appl. No.: 10/034,449

(22) Filed: Dec. 28, 2001

(65) Prior Publication Data

US 2002/0141810 A1 Oct. 3, 2002

(30) Foreign Application Priority Data

Feb. 2, 2001 (JP) ..... 2001-026203

(51) Int. Cl.[7] ..... B65D 27/00
(52) U.S. Cl. ..... 229/67.3; 229/101; 229/928
(58) Field of Search ..... 229/67.3, 928, 229/101

(56) References Cited

U.S. PATENT DOCUMENTS 1,042,488 A * 10/1912 Shaffer ..... 229/67.3
1,194,440 A * 8/1916 Swortfiguer ..... 229/67.3
2,556,568 A * 6/1951 Aikmann ..... 229/101
3,114,492 A * 12/1963 Engstrom ..... 206/425
3,494,637 A * 2/1970 Barrett et al. ..... 281/45
5,707,003 A * 1/1998 Miyake ..... 229/101

* cited by examiner

*Primary Examiner*—Jes F. Pascua
(74) *Attorney, Agent, or Firm*—Law Office of Marc D. Machtinger, Ltd.

(57) ABSTRACT

A filing device (1), which has a reference cover-forming member (2) having a cover (21), a spine (22), and a back cover (23) integrated in one body, and a movable cover-forming member capable (3) of relative movement with respect to and along the inner surface of the reference cover-forming member (2), and in which the reference cover-forming member (2), in the area where the aforementioned spine (22) is formed, is provided with a cover motion-enabling insertion engagement section (25) extending in the longitudinal direction of the spine-forming section, and, along with that, is provided with a guiding section (26) controlling the motion of the movable cover-forming member (3). The movable cover-forming member (3) has a movable cover (31), a movable spine (32), and a movable back cover (33) integrated in one body of a width corresponding at least to the reference cover-forming member (2) and, in the area where said movable spine (32) is formed, there is provided a cover motion-enabling opening engagement section (35), into which the aforementioned cover motion-enabling insertion engagement section (25) is inserted.

9 Claims, 6 Drawing Sheets

FILING DEVICE

TECHNICAL FIELD

The present invention relates to filing devices, and, specifically, to a filing device capable of varying the height of the file.

BACKGROUND OF THE INVENTION

As disclosed in Japanese Unexamined Patent Application Publication No. Hei 11[1999]-5362, prior-art filing devices did have constructions permitting variable file thickness in order to accommodate changes in the amount of the stored materials, such as documents, etc. However, the invention disclosed in said Publication did not include the idea of accommodating changes in the dimensions of the stored items, in particular, that of varying the size of the file in the height direction.

In addition, Japanese Unexamined Patent Application Publication No. 2000-006569 disclosed a construction, in which a clear file was provided with pouches for storage in folded form, which were unfolded for storage when stored materials of sizes larger than the regular size were filed. However, the overall size of the file was fixed, and the storage pouches protruded from the cover of the file.

Thus, generally speaking, in case of the prior-art filing devices described above, it was necessary to prepare filing devices of dimensions corresponding to the size of the stored documents, engineering drawings, etc.; for example, when the size of the materials to be stored was not known before a business trip, one had to select a filing device that could accommodate the largest estimated size.

In addition, even though documents could be stored in foldable storage pouches provided in the filing devices, the stored items protruded from the cover section and the spine section, during transportation, and, for this reason, the stored materials could be damaged by application of a load, such as by impact, etc. from the outside. Thus, after all, one had to prepare bags, boxes, etc. that corresponded in size to the storage pouches in order to protect them in the unfolded state.

SUMMARY OF THE INVENTION

It is an object of the present invention to provide a filing device which improves the defects of the prior art, and, in particular, in addition to possessing the important filing device functionality allowing it to preserve stored items in good condition without external contact, is capable of accommodating changes in the dimensions of the stored materials.

In order to attain the above-mentioned object, the invention preferably utilizes a construction having a reference cover-forming member, which has a cover, a spine, and an back cover integrated in one body, and a movable cover-forming member capable of relative movement with respect to and along the inner surface of said reference cover-forming member. Here, the reference cover-forming member, in the area where the spine is formed, is provided with a cover motion-enabling insertion engagement section extending in the longitudinal direction of the spine-forming section, and, along with that, is provided with a guiding section controlling the motion of the movable cover-forming member, and the movable cover-forming member has a movable cover, a movable spine, and a movable back cover integrated in one body of a width corresponding at least to the reference cover-forming member and, in the area where said movable spine is formed, is provided with a cover motion-enabling opening engagement section, into which the cover motion-enabling insertion engagement section is inserted.

Here, the expression "has . . . integrated in one body" is not limited to constructions, in which the cover, the spine, and the back cover are formed from a single integral member. For example, after forming a cover, a spine, and a back cover form separate members, an integral structure can be formed by bonding or fusing them together.

Because the movable cover, the movable spine, and the movable back cover of the movable cover-forming member in the present invention move along the inner surface of the reference cover-forming member, the dimensions of the filing device can be varied while maintaining the form of the cover enclosing the stored items.

In addition, the filing device preferably further has a movable storage section capable of relative movement with respect to and along the surface of the movable cover-forming member, and said movable storage section and the movable cover-forming member have controlling engagement sections controlling the direction of possible movement, with said controlling engagement sections controlling the direction of possible movement in such a manner that the movable storage section moves relative to the movable cover-forming member in a direction opposite to the direction, in which the movable cover-forming member moves relative to the reference cover-forming member.

Because in the present invention the filing device permits movement of the storage section inside it in response to varying size of the filing device, the storage section can be arranged in the optimum position in accordance with the shape of the documents stored therein.

In addition, in the filing device the movable cover-forming member has a storage section motion-enabling insertion engagement section extending in a direction which is opposite to the direction of extension of the cover motion-enabling insertion engagement section and which is parallel to the longitudinal direction of the spine-forming section, and the movable storage section is provided with a storage section motion-enabling opening engagement section, into which the storage section motion-enabling insertion engagement section is inserted.

Because in the present invention the opening engagement section is provided on the movable storage section side, items stored in the storage section are unlikely to fall out of the engagement section.

In addition, in the filing device the cover motion-enabling insertion engagement section is formed by making a slit in the reference cover-forming member, and the cover motion-enabling opening engagement section is formed by making a slit in the movable cover-forming member.

Because the present invention is based on a construction, in which the cover motion-enabling insertion engagement section and the cover motion-enabling opening engagement section are formed by making slits in the cover-forming members, the number of necessary parts is reduced, and, along with that, the closeness of contact between the inner surface of the reference cover-forming member and the external surface of the movable cover-forming member can be improved.

In addition, in the filing device the cover motion-enabling insertion engagement section is of a shape that continuously narrows down towards the tip side.

In the present invention, the shape of the cover motion-enabling insertion engagement section, which continuously narrows down towards the tip side, facilitates insertion during engagement. In addition, it makes it easier to make the slits.

In addition, in the filing device the shape of the cover motion-enabling insertion engagement section is such that its tip forms a circular arc.

Because in the present invention the shape of the cover motion-enabling insertion engagement section is such that its tip forms a circular arc, a stress concentration is unlikely to be generated in the slit portion of the reference cover-forming member.

KEYS

Figure 1:
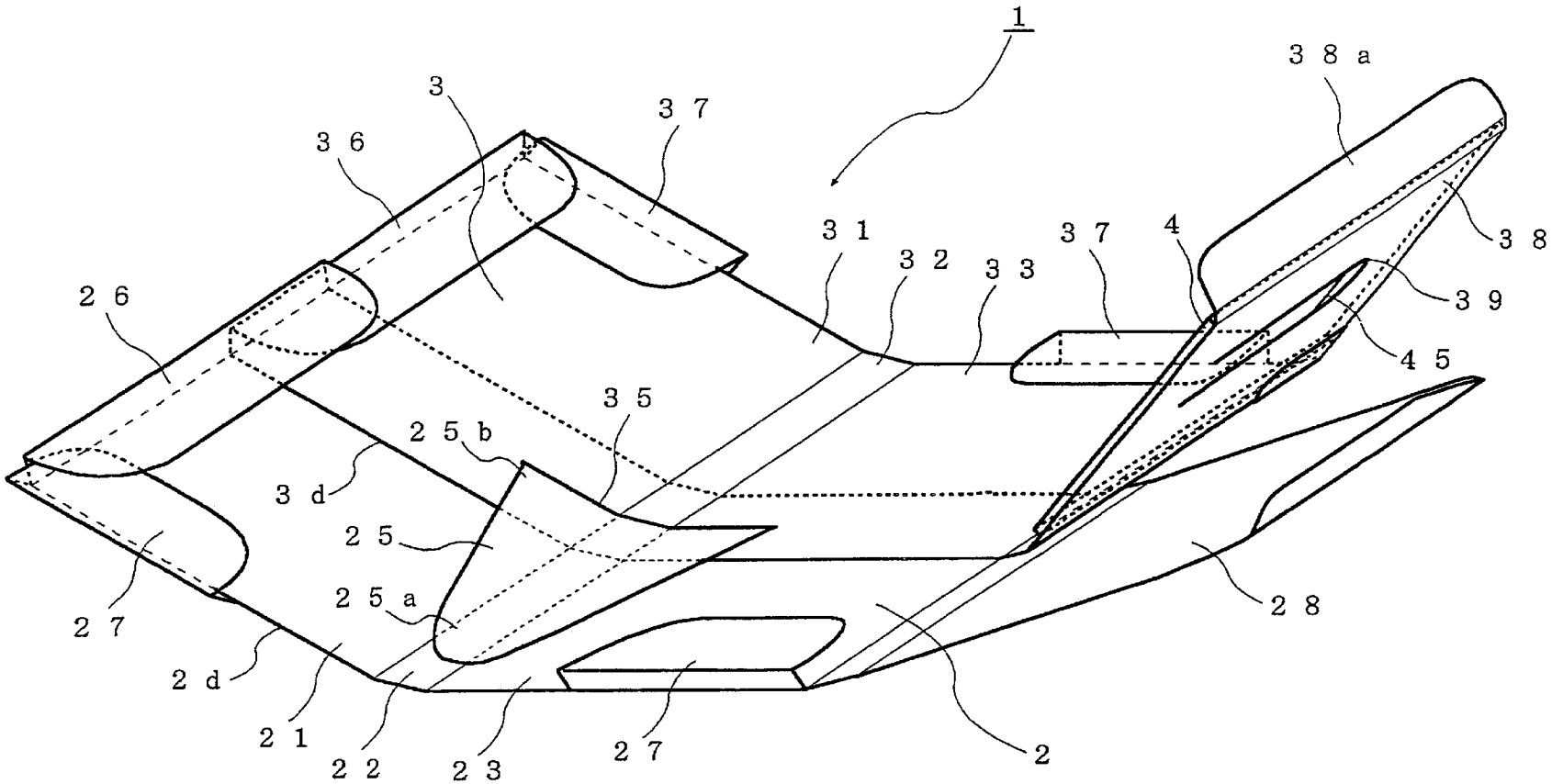
FIG. 1 is a general oblique view of an embodiment of a filing device (1) according to the present invention.

1. Filing device.
2. Reference cover-forming member.
2*d*. Lower end section, in use.
3. Movable cover-forming member.
3*d*. Lower end section, in use.
4. Movable storage section.
21. Cover.
22. Spine.
23. Back cover.
25. Cover motion-enabling insertion engagement section.
25*a*. Tip area.
25*b*. Base section.
26. Guiding section.
27. Guiding section.
28. Flap.
29. Insertion section.
31. Movable cover.
32. Movable spine.
33. Movable back cover.
34. Edge-reinforcing section.
35. Cover movement-enabling opening engagement section.
35*a*. Lower area.
36. Side face-forming section.
37. Top face-forming section.
38. Movable storage section arrangement section.
38*a*. Movable storage section side face-forming section.
39. Storage section movement-enabling insertion engagement section.
41. Side face-forming section.
42. Bottom face-forming section.
43. Top face-forming section.
43*a*. Concave fold.
43*b*. Concave fold.
43*c*. Concave fold.
44. Sliding face-forming section.
45. Storage section movement-enabling opening engagement section.
301. Reference cover-forming member.
302. Cover movement-enabling insertion engagement section.
303. Movable cover-forming member.
304. Band-like engagement section.
305. Stopper section.

DETAILED DESCRIPTION OF THE PREFERRED EMBODIMENT

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Hereinbelow, embodiments of the present invention are explained by referring to FIG. 1~FIG. 6.

Figure 2A:
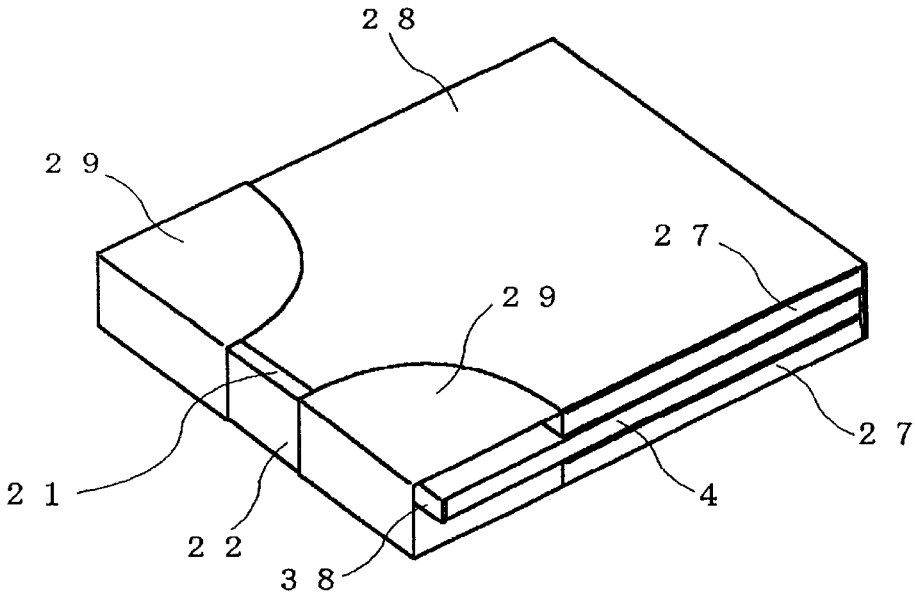
FIG. 2A is an oblique view showing a state, wherein the filing device is rendered as small as possible in the height direction.
Figure 2B:
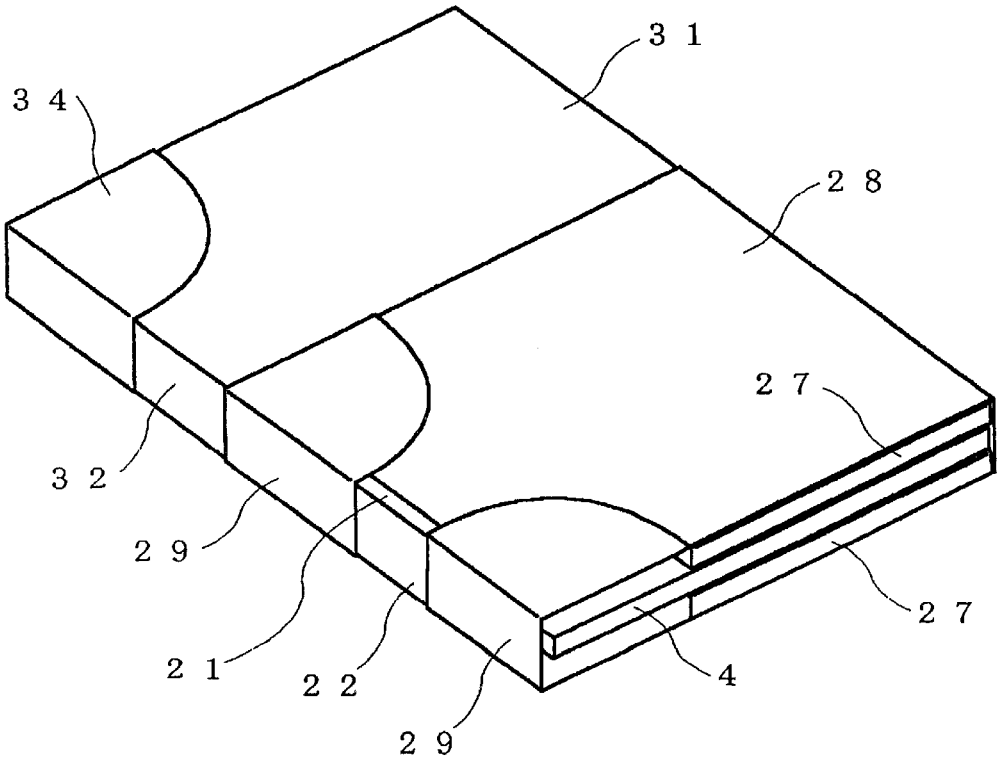
FIG. 2B is an oblique view showing a state, wherein the filing device is rendered as large as possible in the height direction.

FIG. 1 is a general oblique view of an embodiment of a filing device (1) according to the present invention. FIG. 2 is an oblique view showing said filing device (1) in use, in a state wherein the filing device (1) shown in FIG. 1 is closed. Here, FIG. 2(*a*) is an oblique view showing a state, wherein the filing device (1) is rendered as small as possible in the height direction, and FIG. 2(*b*) is an oblique view showing a state, wherein the filing device (1) is rendered as large as possible in the height direction. Explanations regarding FIG. 1 and FIG. 2 are provided hereinbelow.

The filing device (1) is provided with a reference cover-forming member (2) and a movable cover-forming member (3), which is capable of relative movement with respect to and along the inner surface of the reference cover-forming member (2). Furthermore, the filing device (1) is provided with a movable storage section (4) provided inside the filing device (1). Also, the reference cover-forming member (2) has a cover (21), a spine (22), and a back cover (23) integrated in one body, and the movable cover-forming member (3) has a movable cover (31), a movable spine (32), and a movable back cover (33) integrated in one body with a width corresponding at least to the reference cover-forming member (2).

In addition, the reference cover-forming member (2) is provided with a flap (28). Also, as shown in FIG. 2, to maintain the filing device (1) in a closed state, the flap (28) is inserted into insertion sections (29) provided on the front side of the reference cover-forming member (2). In addition to constructions, in which the reference cover-forming member (2) has the cover (21), the spine (22), the back cover (23), and the flap (28) formed integrally therewith, other constructions can be used, in which the filing device (1) is maintained in a closed state by means of specially provided members, such as belts, hooks, etc.

Here, the reference cover-forming member (2), in the area where the spine (22) is formed, is provided with a cover motion-enabling insertion engagement section (25) extending in the longitudinal direction of the section, where the spine (22) is formed. On the other hand, the movable cover-forming member (3), in the area where the movable spine (32) is formed, is provided with a cover motion-enabling opening engagement section (35), into which the cover motion-enabling insertion engagement section (25) is inserted. The cover motion-enabling opening engagement section (35) is a slit-shaped opening extending in a direction intersecting perpendicularly to the direction of insertion of the cover motion-enabling insertion engagement section (25).

As shown in FIG. 1, the filing device (1) is used in a state, wherein the cover motion-enabling insertion engagement section (25) is inserted in the cover motion-enabling opening engagement section (35). As the movable cover-forming member (3) moves relative to the reference cover-forming member (2), the cover motion-enabling opening engagement section (35) changes its engagement position in the range from the tip area (25*a*) to the base section. (25*b*) of the cover motion-enabling insertion engagement section (25).

Here, when the cover motion-enabling opening engagement section (35) is in the tip area of the cover motion-enabling insertion engagement section (25), in other words, in a state, wherein the lower end section (2*d*) of the reference cover-forming member (2) and the lower end section (3*d*) of the movable cover-forming member (3) coincide, as shown in FIG. 2(*a*), the size of the filing device (1) in the height direction reaches its minimum and coincides with the height of the spine (22). On the other hand, in a state, wherein the cover motion-enabling opening engagement section (35) is at the same position as the base section (25*b*), as shown in FIG. 2(*b*), the size of the filing device (1) in the height direction reaches its maximum. In addition, as will be explained in detail hereinbelow, the maximum height of the filing device (1) is determined by the relative relationship, in which the base section (25*b*) of the cover motion-enabling insertion engagement section (25) and the cover motion-enabling opening engagement section (35) are arranged with respect to one another.

In addition, the reference cover-forming member (2) is provided with a guiding section (26) and the movable cover-forming member (3) is provided with a side face-forming section (36). Here, the inner surface of the guiding section (26) and the side face-forming section (36) are provided such that they are in contact with one another. As a result, the side face-forming section (36) moves along the guiding section (26), and the guiding section (26) fulfills the function of controlling the direction, in which the movable cover-forming member (3) slides, so as to make it coincide with the direction, in which the cover motion-enabling insertion engagement section (25) extends. In addition, the guiding section (26), in conduction with the cover motion-enabling insertion engagement section (25), prevents the movable cover-forming member (3) from shifting in the direction intersecting perpendicularly to the direction of sliding.

Also, the reference cover-forming member (2) is provided with a guiding section (27) at the lower end section (2*d*). Guiding section (27) also controls the motion of the movable cover-forming member (3) relative to the reference cover-forming member (2). Specifically, the guiding section (27) acts as a stopper for the movable cover-forming member (3) at the lower end section (2*d*) of the reference cover-forming member (2). This is done to avoid disengagement between the cover motion-enabling insertion engagement section (25) and the cover motion-enabling opening engagement section (35) when the dimensions of the filing device (1) are reduced.

Here, in the present embodiment, the top face-forming sections (37) are provided on the movable cover-forming member (3), with said the top face-forming sections (37), along with the above-described guiding section (26), guiding section (27), and side face-forming section (36), holding the stored items stored in the filing device (1). For example, the guiding section (26) and the side face-forming section (36) ensure that stored items do not fall out from the side sections facing the spine (22) and the movable spine (32). In addition, the guiding section (27) acts as a stopper for stored items in the lower end section of the filing device (1), preventing stored items from falling out from the bottom. Also, the top face-forming section (37) acts as a stopper for stored items in the top end section of the filing device (1), preventing stored materials from falling out from the top.

Furthermore, the movable cover-forming member (3) is provided with a movable storage section arrangement section (38). A storage section motion-enabling insertion engagement section (39) is provided in the movable storage section arrangement section (38). The storage section motion-enabling insertion engagement section (39) and a storage section motion-enabling opening engagement section (45) form a controlling engagement section controlling the direction of possible movement during motion of the movable storage section (4) in the filing device along the inner surface of the movable storage section arrangement section (38). The controlling engagement section controls movement such that the movable storage section (4) moves relative to the movable cover-forming member (3) in a direction opposite to the direction, in which the movable cover-forming member (3) moves relative to the reference cover-forming member (2).

More specifically, the storage section motion-enabling insertion engagement section (39) extends so that its tip is positioned in a direction opposite to the direction, in which the cover motion-enabling insertion engagement section (25) extends, i.e. in a direction parallel to the longitudinal direction of the spine (22). In addition, the storage section motion-enabling opening engagement section (45), into which the storage section motion-enabling insertion engagement section (39) is inserted, is a slit-shaped opening extending in a direction intersecting perpendicularly to the direction of insertion.

Additionally, as will be described hereinbelow, in the present Embodiment the storage section motion-enabling insertion engagement section (39) and storage section motion-enabling opening engagement section (45) are formed by making slits. To reduce the amount of required slitting of the movable storage section (4), the storage section motion-enabling opening engagement section (45) is provided on the movable storage section (4) side. The design, however, is not limited to constructions of this type, and, for example, it is possible to use constructions, in which, along with providing a separate storage section motion-enabling insertion engagement section in the movable storage section (4), a storage section motion-enabling opening engagement section is provided in the movable cover-forming member (3), in other words, constructions, in which there is engagement between the reference cover-forming member (2) and the movable cover-forming member (3).

As was explained above, the construction of the filing device (1) depicted in FIG. 1 has two large storage spaces, separated by a movable storage section arrangement section (38) comprising the movable storage section (4). In other words, stored items are placed in the device from the cover (21) and movable cover (31) side and from the back cover (23) and movable back cover (33) side, respectively.

Figure 3A:
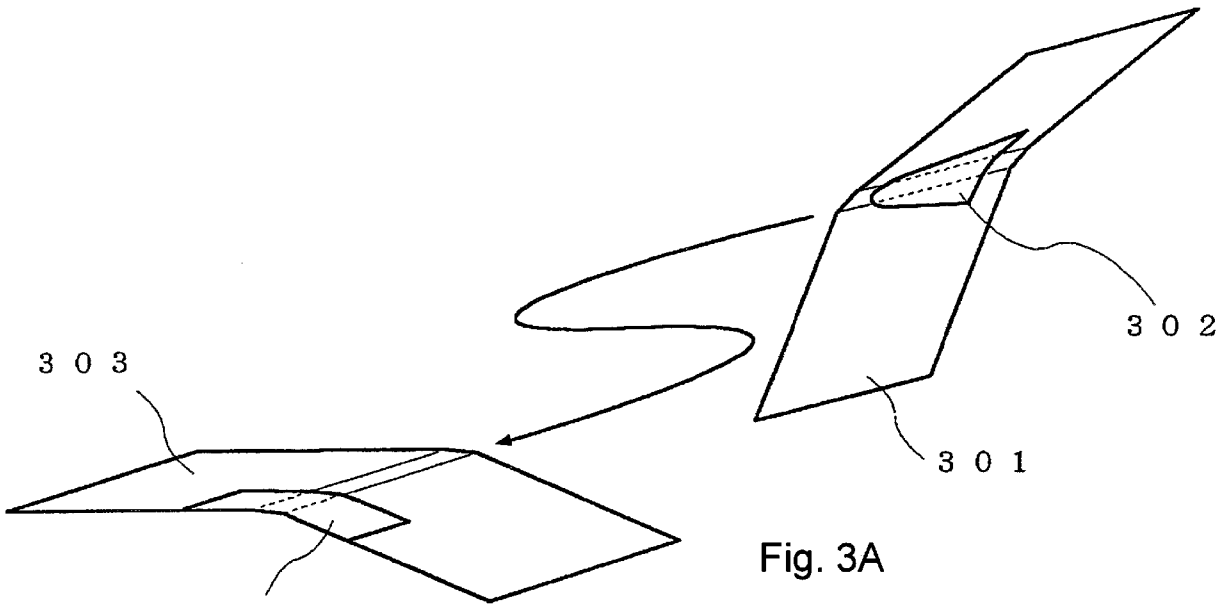
FIG. 3A is a schematic oblique view of a basic configuration.
Figure 3B:
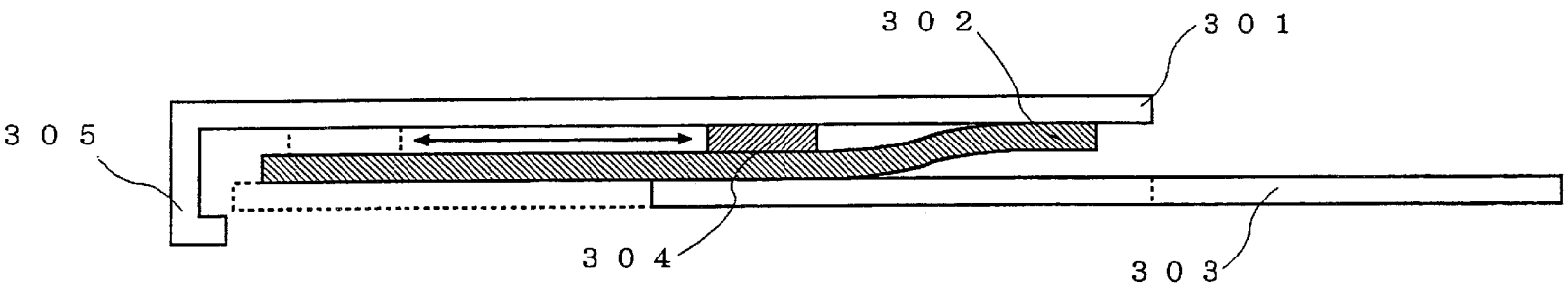
FIG. 3B is a schematic cross-sectional view of an engaged state.

Next, the mechanism of motion of the above-described reference cover-forming member (2) and movable cover-forming member (3) is explained by referring to FIG. 3. FIG. 3(*a*) is a schematic oblique view showing the basic mechanism of motion, and FIG. 3(*b*) is a schematic cross-sectional view showing a state of engagement. Hereinbelow, in order to facilitate explanation, the reference numerals are different from the names used in FIG. 1 and FIG. 2, and "reference cover-forming member (301)" and"movable cover-forming member (303)" are used instead.

In FIG. 3, the reference cover-forming member (301) is provided with a cover motion-enabling insertion engagement section (302). Here, the base section of the cover motion-enabling insertion engagement section (302) is bonded to the inner surface of the reference cover-forming member (301). In addition, the movable cover-forming member (303) is provided with a band-like engagement section (304) providing engagement with the cover motion-enabling insertion engagement section (302). In the band-like engagement section (304), both end portions of the band-like member are bonded to the outer surface of the movable cover-forming member (303), and an opening in formed therein for inserting the cover motion-enabling insertion engagement section (302).

As shown in FIG. 3(*a*), the cover motion-enabling insertion engagement section (302) is inserted into the opening formed in the band-like engagement section (304). The band-like engagement section (304) is positioned as shown with a dotted line in FIG. 3(*b*). The reference cover-forming member (301) is provided with a stopper section (305) to prevent the disengagement of the cover motion-enabling insertion engagement section (302) and the band-like engagement section (304). Sliding the movable cover-forming member (303) to the right and to the left makes it possible to regulate the height of the cover formed by the reference cover-forming member (301) and movable cover-forming member (303).

As explained above, the height of the external cover of the filing device can be regulated by using a combination of the major elements constituting the external cover of the filing device (1), i.e. the cover (21) and the movable cover (31), the spine (22) and the movable spine (32), and the back cover (23) and the movable back cover (33), and, for this reason, even if the size of the filed documents, drawings, etc. increases, the documents etc. can be stored in a cover that matches their size without any protruding documents, which makes it possible to prevent the documents etc. from being soiled, crumpled, etc.

In addition, the movable storage section (4) slides relative to the movable cover-forming member (3) based on the above-described motion mechanism and the same principle.

Figure 4:
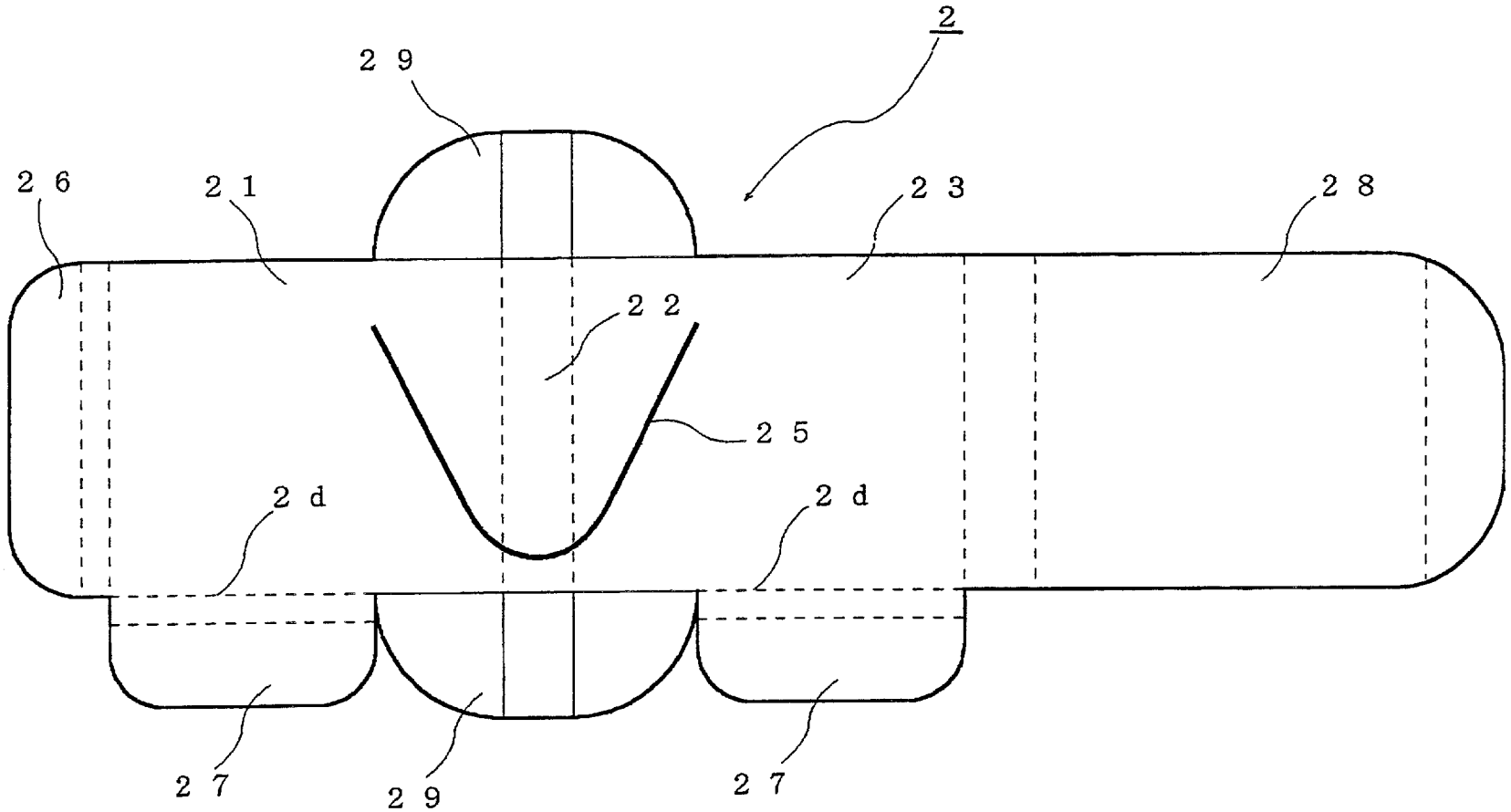
FIG. 4 is a schematic development view showing of an embodiment of a reference cover-forming member forming part of the filing device illustrated in FIG. 1.
Figure 5:
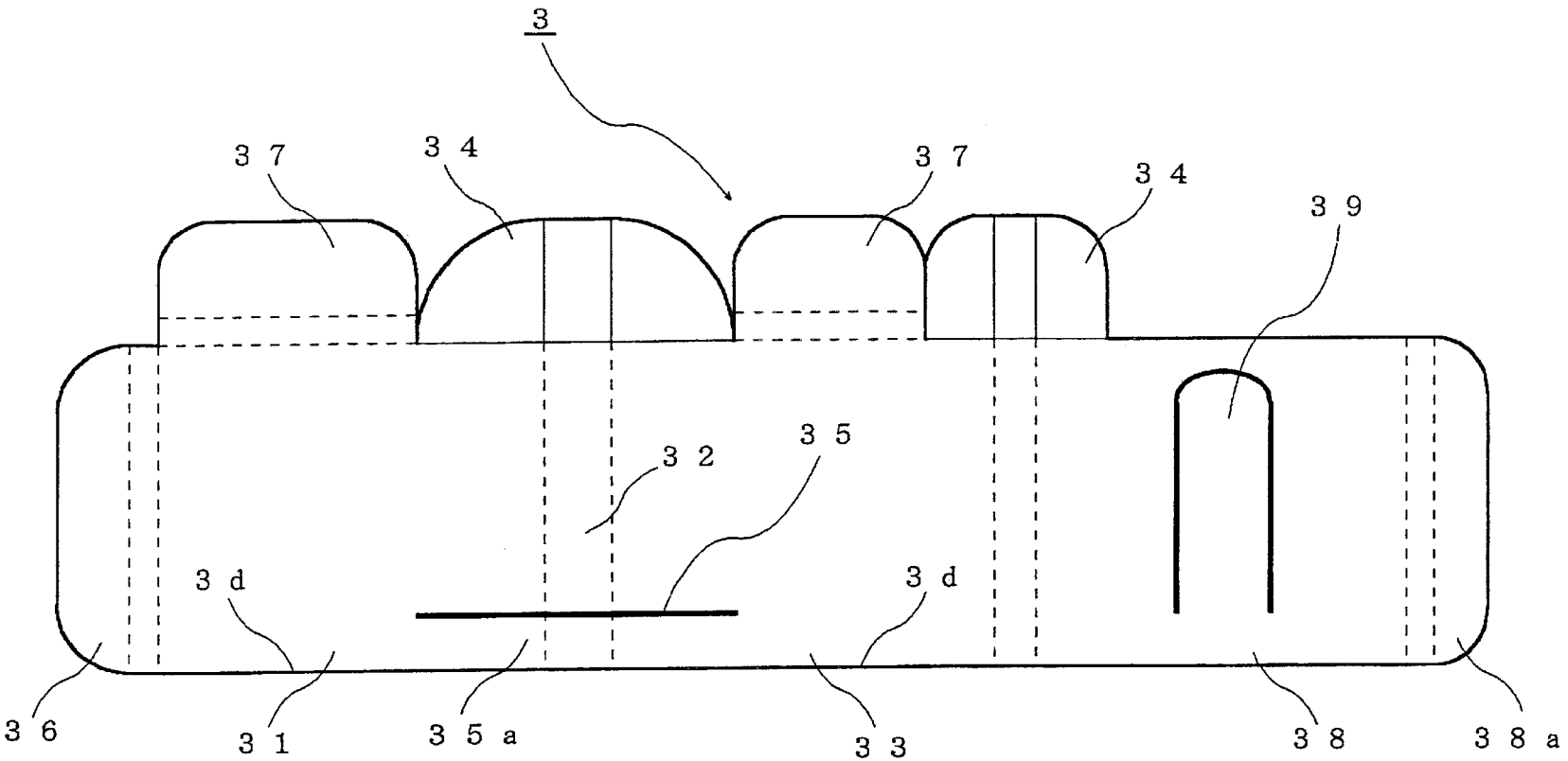
FIG. 5 is a schematic development view of an embodiment of a movable cover-forming member forming part of the filing device illustrated in FIG. 1.
Figure 6:
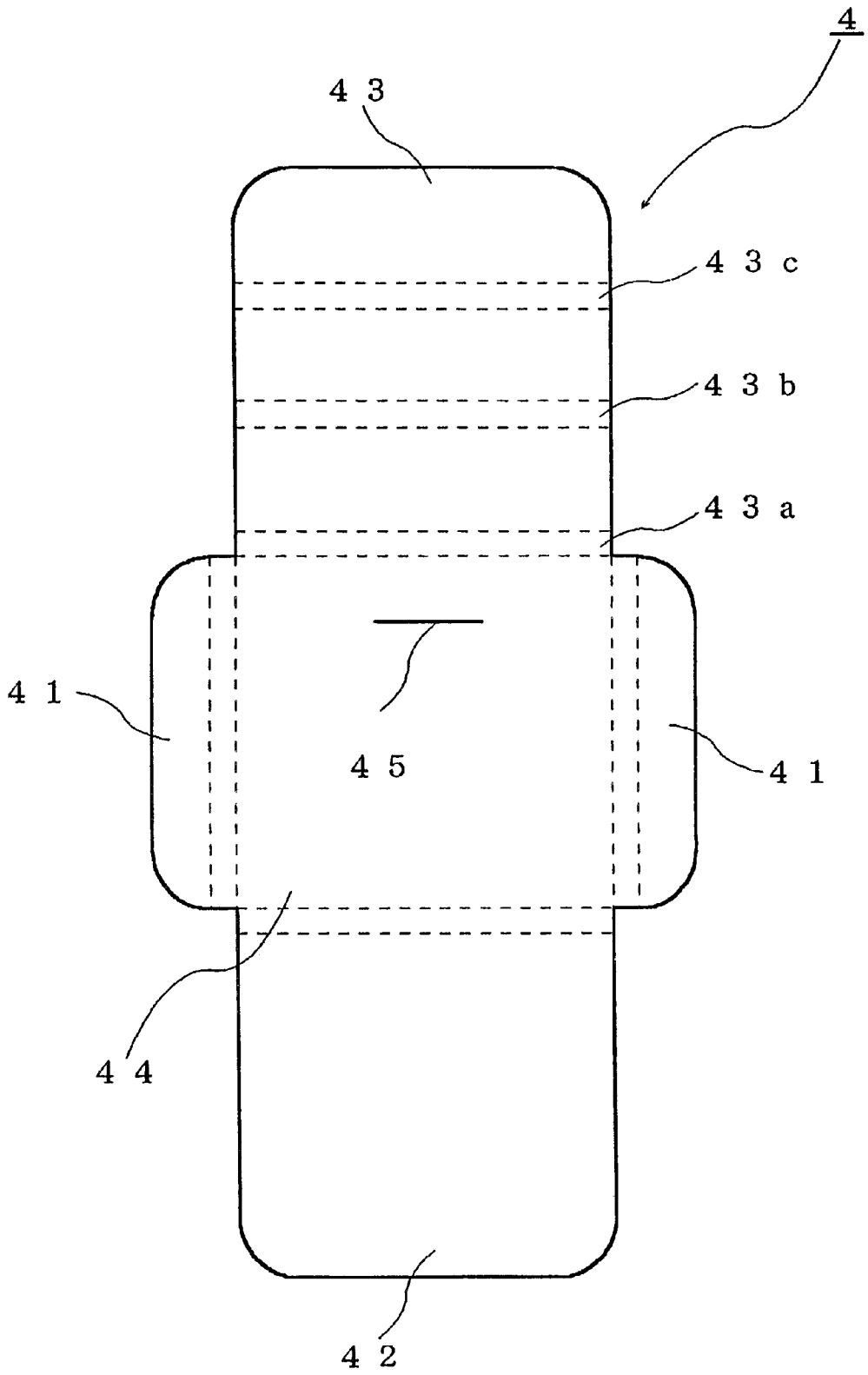
FIG. 6 is a schematic development view of an embodiment of a movable storage section forming part of the filing device illustrated in FIG. 1.

Hereinbelow, referring to FIG. 4~FIG. 6, explanations are provided regarding the fabrication of the filing device (1). FIG. 4 is a schematic development view showing the reference cover-forming member (2) from the inner surface side, seen from above, and FIG. 5 is a schematic development view of the movable cover-forming member (3) from the inner surface side, seen from above. In addition, FIG. 6 is a schematic development view of the movable storage section (4) from the inner surface side, seen from above. In FIG. 4~FIG. 6, solid lines indicate convex folds and dotted lines indicate concave folds.

First of all, explanations are provided regarding the fabrication of the reference cover-forming member (2). As shown in FIG. 4, the reference cover-forming member (2) has a cover (21), a spine (22), a back cover (23), a guiding section (26), a guiding section (27), and a flap (28) integrated in one body; however, the member is not limited to members formed out of a single sheet by blanking, etc. For example, an integral construction can be obtained by forming the cover (21), the spine (22), the back cover (23), etc. from separate members and then bonding or fusing them together.

The cover motion-enabling insertion engagement section (25), unlike the one depicted in FIG. 3, is formed by making a slit in the reference cover-forming member (2). In addition, so long as it permits making slits therein, the reference cover-forming member (2) can be made of any material, such as, for example, a paper sheet, a plastic sheet or a vinyl sheet, etc.

Hereinbelow, explanations are provided regarding the slit that forms the cover motion-enabling insertion engagement section (25). Specifically, the portion, in which the spine (22) is formed, is positioned in the center, and the slit is made symmetrically on the right and left side thereof starting from areas of the cover (21) and back cover (23) adjacent to the spine (22). By using a construction, in which the cover motion-enabling insertion engagement section (25) has a portion that is wide enough for the section to run across the area where the spine (22) is formed, and also across areas corresponding to the cover (21) and back cover (23), contact is made possible with three different surfaces of the sliding movable cover-forming member (3). As a result, even shifting the movable cover-forming member (3) such that the filing device (1) reaches its maximum size, as shown in FIG. 2(*b*), is unlikely to make possible changes in size due to impact from outside etc. because resistance to sliding can be increased in comparison with the case, wherein the cover motion-enabling insertion engagement section (25) is located only in the area of the spine (22).

In addition, the slit is shaped so that the width of the cover motion-enabling insertion engagement section (25) becomes continuously and gradually narrower towards the lower end section of the spine (22), in other words, the tip of cover motion-enabling insertion engagement section (25). This facilitates insertion during engagement with the cover motion-enabling opening engagement section (35). Furthermore, because the width becomes continuously narrower, the fabrication of the slit is facilitated in comparison with a slit of a stepped shape or other shapes.

Furthermore, when the slit is made, it is imparted an arcuate shape in the area of the tip of the cover motion-enabling insertion engagement section (25). Because the area of the tip of the cover motion-enabling insertion engagement section (25) corresponds to the portion of the spine that is repeatedly bent, this area is prone to accumulation of stress when the device is in use. Thus, by using an arcuate slit of a certain curvature, the distribution of stress is smoothed out and stress concentration, rupture, etc. in certain locations of the slit of the reference cover-forming member (2) can be avoided. In addition, because the inner surface of the cover motion-enabling insertion engagement section (25) is exposed to the inside of the filing device (1), in case of a shape with rectangular corners, the stored items might be caught thereby, making filing more difficult, and for this reason such as shape is avoided.

The guiding section (26), guiding section (27) and flap (28) are formed by making concave folds. On the other hand, the insertion sections (29) are formed by making convex folds, folding back to the outer surface side of the reference cover-forming member (2). Here, as described above, the flap (28) is inserted in the folded-back portion, and the effects that the fold-back construction of the insertion sections (29) provides consist in an enhancement of durability and an improvement in the strength of the upper end and lower end of the spine (22).

Next, explanations are provided regarding the fabrication of the movable cover-forming member (3). As shown in FIG. 5, the movable cover-forming member (3) has a movable cover (31), a movable spine (32), a movable back cover (33), a side face-forming section (36), a top face-forming section (37), a movable storage section arrangement section (38), and a movable storage section side face-forming section (38*a*). In the same manner as in the case of the reference cover-forming member (2), the movable cover-forming member (3) is not limited to members formed out of a single integral sheet by blanking etc., and, for example, an integral construction can be obtained by forming the movable cover (31), movable spine (32), movable back cover (33), etc. from different members and then bonding or fusing them together.

In addition, the cover motion-enabling opening engagement section (35), in the same manner as the cover motion-enabling insertion engagement section (25), is formed by making a cut in the movable cover-forming member (3). The cut is slit-shaped, and its length corresponds to the width of the base section (25*a*) of the cover motion-enabling insertion engagement section (25). In addition, so long as it permits making slits therein, the movable cover-forming member (3) can be made of any material, such as, for example, a paper sheet, a plastic sheet or a vinyl sheet, etc.

Hereinbelow, detailed explanations are provided regarding the slit that forms the cover motion-enabling opening engagement section (35). More specifically, a slit-shaped cut is made from areas of the movable cover (31) and movable back cover (33) adjacent to the movable spine (32) on both sides of the portion, where the movable spine (32) is formed. The width of the split is practically equal to the maximum width of the cover motion-enabling insertion engagement section (25). In addition, the gap between the aforementioned base section of the cover motion-enabling insertion engagement section (25) and the cover motion-enabling opening engagement section (35) is such that the distance therebetween allows for the movable cover-forming member (3) to move relative to the reference cover-forming member (2).

The side face-forming section (36), top face-forming section (37), movable storage section arrangement section (38), and the movable storage section side face-forming section (38*a*) are formed using concave folds. On the other hand, the edge-reinforcing section (34) is formed using convex folds, by folding back to the outer surface side of the movable cover-forming member (3). Here, the effects that the fold-back construction of the edge-reinforcing section (34) provides consist in an improvement in the strength of the top end of the movable spine (32) and the top end on the side face opposite the movable spine (32).

As explained above, forming the cover motion-enabling insertion engagement section (25) and cover motion-enabling opening engagement section (35) by making slits permits reduction in the number of parts because the operation achieves its purpose without requiring separately provided members to be used. Furthermore, in the engagement section used to enable cover movement, an intertwined construction is possible, wherein the cover motion-enabling insertion engagement section (25) is directed inward and the lower area (35*a*) of the cover motion-enabling opening engagement section (35) is directed outward. As a result, as shown in FIG. 3, the closeness of contact between the inner surface of the reference cover-forming member (2) and the outer surface of the movable cover-forming member (3) can be improved in comparison with the case, wherein engagement sections are formed from separately provided members.

In addition, a storage section motion-enabling insertion engagement section (39) is formed in the movable cover-forming member (3). Here, the tip section of the storage section motion-enabling insertion engagement section (39) is formed such that at least two corners thereof are imparted an arcuate shape. This facilitates insertion into the storage section motion-enabling opening engagement section (45) provided in the movable storage section (4), which is explained hereinbelow. Furthermore, the storage section motion-enabling insertion engagement section (39), unlike the cover motion-enabling insertion engagement section (25) described above, is formed by making a slit so as provide a practically uniform width. This is done to avoid an unnecessary increase in the width of the storage section motion-enabling opening engagement section (45).

Next, explanations are given regarding the fabrication of the movable storage section (4). As shown in FIG. 6, the movable storage section (4) has a side face-forming section (41), a bottom face-forming section (42), a top face-forming section (43), and a sliding face-forming section (44) integrated in one body; however, it is not limited to sections formed by blanking or such from a single integral sheet. For example, the side face-forming section (41), the bottom face-forming section (42), the top face-forming section (43), and the sliding face-forming section (44) can be formed out of different members and then bonded or fused into an integral construction.

In addition, the storage section motion-enabling opening engagement section (45) is formed by making a cut in the movable cover-forming member (3), in the same manner as in the case of the storage section motion-enabling insertion engagement section (39). The resultant cut is slit-shaped, its length corresponding to the width of the storage section motion-enabling insertion engagement section (39). In addition, so long as it permits making slits therein, the movable storage section (4) can be made of any material, such as, for example, a paper sheet, a plastic sheet or a vinyl sheet, etc.

The side face-forming section (41), the bottom face-forming section (42), and the top face-forming section (43) are formed by making concave folds. Here, the top face-forming section (43) has a plurality of concave folds (43*a*, 43*b*, 43*c*), forming the top face of the storage section. Fold (43*a*) is located in a position, folding in which provides for a minimal size of the filing device (1) as shown in FIG. 2(*a*). In addition, fold (43*c*) is located in a position, folding in which permits maximizing the capacity of the movable storage section (4), as in the case of the largest size of the filing device (1) illustrated in FIG. 2(*b*). Also, the location of fold (43*b*) can be in any position between folds (43*a*) and (43*c*); in the present Embodiment it is in an intermediate position.

Thus, when the filing device (1) has a maximum size, which is illustrated in FIG. 2(*b*), any of the folds (43*a*, 43*b*, 43*c*) can be selected in accordance with the size of the items stored in the movable storage section (4). Here, the movable storage section side face-forming section (38*a*) provided in the movable cover-forming member (3) acts as a guiding section for controlling the direction, in which the movable storage section (4) moves. The storage section motion-enabling insertion engagement section (39) is formed so that it has a practically uniform width, and because the width of the storage section motion-enabling opening engagement section (45) corresponds thereto, shifting in the crosswise direction is unlikely to occur, and the part is easy to move when the device is in use.

As described above, providing the movable storage section (4) in the movable storage section arrangement section (38) permits variation in the size of the movable storage section (4) in the filing device (1) in accordance with the shape etc. of the stored items contained inside, as well as makes it possible to change their arrangement. Therefore, bin this manner, the construction permits selectable positioning of the movable storage section (4), which increases the efficiency of space utilization in the filing device (1).

As explained above, the filing device (1) illustrated in FIG. 1 is fabricated by folding the reference cover-forming member (2), the movable cover-forming member (3), and the movable storage section (4) and combining them in one piece. More specifically, first of all, the inner surface of the reference cover-forming member (2) is aligned with the outer surface of the movable cover-forming member (3) and, in this state, the cover motion-enabling insertion engagement section (25) is inserted into the cover motion-enabling opening engagement section (35). Then, the outer surface of the movable storage section (4) is aligned with the inner surface of the movable storage section arrangement section (38) of the movable cover-forming member (3) and, in this state, the storage section motion-enabling insertion engagement section (39) is inserted into storage section motion-enabling opening engagement section (45). After that, the filing device (1) is closed, with the movable storage section (4) folded inside the filing device (1), whereupon the flap (28) is inserted in the insertion sections (29). This produces a filing device (1) in the state illustrated in FIG. 2.

As a result of the above-described construction and operation, the present invention, preferably provides a heretofore unavailable, superior filing device which, owing to movable cover-forming members, is capable of matching the size of the stored documents etc. without the documents etc. being exposed even if the size of the documents and drawings filed therein increases, and can prevent the documents etc. from being soiled or crumpled.

Also, the invention preferably in addition to producing the effects of the invention makes it possible to move the movable storage section inside the filing device in response to changes in the size of the filing device, and, for this reason, permits arrangement of the movable storage section in an optimum position depending on the shape of the stored items filed therein.

Also, the invention preferably in addition to producing the effects of the invention provides an opening engagement section on the side of the storage section, and, for this reason, articles held in the storage section are unlikely to fall out of the engagement section.

Also, the invention preferably in addition to producing the effects of the invention set provides a construction, in which a slit is made in the cover-forming member, and, for this reason, along with reducing the number of the necessary components, the closeness of contact between the inner surface of the reference cover-forming member and the outer surface of the movable cover-forming member can be improved.

Also, in the invention preferably in addition to producing the effects of the invention the aforementioned cover motion-enabling insertion engagement section is imparted a shape such that its width continuously narrows down towards the tip side, facilitating insertion during engagement. In addition, this makes it easier to make the slit.

Also, in the invention preferably in addition to producing the effects of the invention the aforementioned cover motion-enabling insertion engagement section is imparted a shape such that an arc is formed in the tip area, and, for this reason, stress concentration is unlikely to occur in the slit section of the reference cover-forming member.

While the specific embodiments have been illustrated and described, numerous modifications come to mind without significantly departing from the spirit of the invention, and the scope of protection is only limited by the scope of the accompanying claims.

What is claimed is:

1. A filing device having a reference cover-forming member, which has a cover, a spine, and a back cover integrated in one body, and a movable cover-forming member capable of relative movement with respect to and along the inner surface of said reference cover-forming member, wherein said filing device is further characterized by the fact that the reference cover-forming member, in the area where said spine is formed, is provided with a cover motion-enabling insertion engagement section extending in the longitudinal direction of said spine-forming section, and, along with that, is provided with a guiding section controlling the motion of said movable cover-forming member, and the movable cover-forming member has a movable cover, a movable spine, and a movable back cover integrated in one body of a width corresponding at least to said reference cover-forming member and, in the area where said movable spine is formed, is provided with a cover motion-enabling opening engagement section, into which said cover motion-enabling insertion engagement section is inserted.

2. The filing device according to claim 1, wherein said filing device is further characterized by the fact that it has a movable storage section capable of relative movement with respect to and along the surface of said movable cover-forming member, and said movable storage section and said movable cover-forming member have controlling engagement sections controlling the direction of possible movement, with said controlling engagement sections controlling the direction of possible movement such that said movable storage section moves relative to said movable cover-forming member in a direction opposite to the direction, in which said movable cover-forming member moves relative to said reference cover-forming member.

3. The filing device according to claim 2, wherein said filing device is characterized by the fact that said movable cover-forming member has a storage section motion-enabling insertion engagement section extending in a direction opposite to the direction, in which said cover motion-enabling insertion engagement section extends parallel to the longitudinal direction of said spine-forming section, and said movable storage section is provided with a storage section motion-enabling opening engagement section, into which said storage section motion-enabling insertion engagement section is inserted.

4. The filing device according to claim 1, wherein said filing device is characterized by the fact that said cover motion-enabling insertion engagement section is formed by making a slit in said reference cover-forming member, and said cover motion-enabling opening engagement section is formed by making a slit in said movable cover-forming member.

5. The filing device according to claim 4, wherein said filing device is characterized by the fact that said cover motion-enabling insertion engagement section is of a shape that continuously narrows down towards the tip side.

6. The filing device according to claim 4, wherein said filing device is characterized by the fact that the shape of said cover motion-enabling insertion engagement section is such that its tip forms a circular arc.

7. The filing device according to claim 2, wherein said filing device is characterized by the fact that said cover motion-enabling insertion engagement section is formed by making a slit in said reference cover-forming member, and said cover motion-enabling opening engagement section is formed by making a slit in said movable cover-forming member.

8. The filing device according to claim 3, wherein said filing device is characterized by the fact that said cover motion-enabling insertion engagement section is formed by making a slit in said reference cover-forming member, and said cover motion-enabling opening engagement section is formed by making a slit in said movable cover-forming member.

9. The filing device according to claim 5, wherein said filing device is characterized by the fact that the shape of said cover motion-enabling insertion engagement section is such that its tip forms a circular arc.

* * * * *